US005568768A

United States Patent [19]

Wolfe et al.

[11] Patent Number: 5,568,768

[45] Date of Patent: Oct. 29, 1996

[54] CLEANING APPARATUS FOR OFFSET PLATES

[75] Inventors: David Wolfe, Amherst; Samuel D. Zerillo, Hillsboro, both of N.H.

[73] Assignee: Presstek, Inc., Hudson, N.H.

[21] Appl. No.: 433,987

[22] Filed: May 4, 1995

[51] Int. Cl.[6] ..... B41F 35/00; B41L 41/00

[52] U.S. Cl. ..... 101/425; 101/423

[58] Field of Search ..... 15/256.53; 101/425, 101/423, 424; 355/269

[56] References Cited

U.S. PATENT DOCUMENTS

| | | | |
|---|---|---|---|
| 2,844,123 | 7/1958 | Hayford | 101/425 |
| 3,735,702 | 5/1973 | Kossak | 101/425 |
| 3,781,107 | 12/1973 | Ruhland | 15/256.53 |
| 4,953,252 | 9/1990 | Akisawa | 101/425 |
| 5,086,701 | 2/1992 | Gasparrini et al. | 101/423 |
| 5,123,354 | 6/1992 | Loos | 101/425 |

FOREIGN PATENT DOCUMENTS

| | | | |
|---|---|---|---|
| 2474-899 | 8/1981 | France | 15/256.53 |
| 562687 | 6/1975 | Switzerland | 101/425 |

*Primary Examiner*—Edgar S. Burr
*Assistant Examiner*—Daniel J. Colilla
*Attorney, Agent, or Firm*—Cesari and McKenna

[57] ABSTRACT

Cleaning apparatus for cleaning a lithographic plate mounted to a rotary plate cylinder comprises an endless belt having a segment extending close to and substantially parallel to the cylinder. Plate cleaning pads are mounted to the belt all along the belt and a motor advances the belt along the cylinder. When cleaning, a bladder is caused to inflate thereby pressing the belt segment and cleaning pads thereon against the plate mounted to the plate cylinder while the cylinder rotates.

15 Claims, 2 Drawing Sheets

CLEANING APPARATUS FOR OFFSET PLATES

This invention relates to offset lithography. It relates especially to apparatus for cleaning lithographic plates during or following imaging of the plate.

BACKGROUND OF THE INVENTION

In offset lithography, an image is present on a plate as a pattern of ink-accepting and ink-repellent surface areas. In a typical sheet-fed press system, the plate is mounted to a plate cylinder, is inked and makes contact with the compliant surface of a blanket cylinder which, in turn, applies the image to paper sheets pinned to an impression cylinder, which brings the sheets into contact with the blanket cylinder.

Traditionally, the plates for an offset press have usually been produced photographically. More recently, however, a number of electronic alternatives have been developed, some of which can be used on press. With such systems, a digitally controlled imaging device on a write head alters the ink-receptivity of a plate blank mounted to a cylinder in a pattern representative of the image to be printed. Such imaging devices include sources of electromagnetic-radiation pulses such as lasers and spark or ion discharge sources which physically alter the plate blank, thereby producing "dots" which collectively form a desired image; see e.g., U.S. Pat. Nos. 5,148,746; 5,385,092; 5,379,698 and 5,249,525.

One such plate, described in U.S. Pat. No. 5,148,746, comprises a silicon surface layer which is ink repellent, a thin intermediate layer of metal such as aluminum or titanium and an ink-receptive base or substrate of a film material such polyester marketed under the trademark Mylar (duPont) or Melinex (ICI). That plate may be imaged by delivering spark or ion discharge pulses to the plate which burn through the silicone layer and vaporize or ablate the metal intermediate layer. The imaging pulses effectively detach the ink repellent silicon layer from the ink receptive substrate, facilitating easy removal of the silicone at the image spots. After the plate is cleaned, the plate will carry an image composed of a multiplicity of image dots which have relatively regular boundaries on all sides and are substantially free of debris.

Another plate of this general type, described in U.S. Pat. No. 5,385,092 and which is imaged photographically, comprises an ink repellent surface layer, e.g., silicone, coated onto a photosensitive layer, which is itself coated onto a substrate of suitable stability (e.g., an aluminum or titanium sheet). Upon exposure to actinic radiation, the photosensitive layer cures to a state that destroys its bonding to the surface layer. After exposure, a treatment is applied to deactivate the photoresponse of the photosensitive layer in unexposed areas and to further improve anchorage of the surface layer to these areas. Immersion of the exposed plate in developer results in dissolution and removal of the surface layer at those portions of the plate surface that have received radiation, thereby exposing the ink-receptive, cured photosensitive layer. That type of plate also requires post imaging cleaning.

Various approaches have been suggested for removing plate debris produced in the course of platemaking and specifically in connection with platemaking processes involving ablation or removal of one or more material layers of the plate. One such cleaning system is disclosed in the above U.S. Pat. No. 5,148,746. Basically, that system comprises a rotating brush mounted on the writing head which can be moved into contact with the surface of a lithographic plate mounted to a plate cylinder. That system also delivers a cleaning fluid to the brush in order to assist the debris-removal action thereof.

While that prior plate cleaning apparatus operates satisfactorily in many respects, it is relatively slow because the brush only cleans a relatively small area of the plate at any given time. In other words, the brush head must be moved along the entire length of the plate cylinder in order to clean the entire surface area of the plate.

Furthermore, with some plate constructions, that prior cleaning apparatus is not sufficiently effective in removing all of the debris from the plate. This is partly due to the construction of the brush head itself which is simply comprised of bristles and partly due to the fact that insufficient provision is made for removing debris from the brush.

SUMMARY OF THE INVENTION

Accordingly, it is an object of the present invention to provide improved apparatus for cleaning lithographic plates and other sheet-like recording media.

Another object of the invention is to provide such cleaning apparatus which may be incorporated into an offset press or a platemaker so that it can clean a plate during or immediately following imaging of the plate or which may be a stand alone cleaner associated with a platemaker.

Another object of the invention is to provide cleaning apparatus of this general type which can clean an offset plate in a minimum amount of time.

A further object of the invention is to provide cleaning apparatus which is particularly effective in cleaning lithographic plates comprising a plurality of layers some of which are ablated or otherwise removed during imaging of the plates.

Still another object of the invention is to provide apparatus for cleaning lithographic plates which can operate for a relatively long period of time without maintenance.

Other objects will, in part, be obvious and will, in part, appear hereinafter.

The invention accordingly comprises the features of construction, combination of elements and arrangement of parts which will be exemplified in the following detailed description, and the scope of the invention will be indicated in the claims.

Briefly, our cleaning apparatus comprises a movable elongated belt loop which can be mounted to a machine frame supporting a rotary plate cylinder. The cylinder may constitute part of a stand alone cleaning apparatus or part of an offset press or part of a platemaking apparatus for imaging lithographic plates off press. Preferably, the belt loop is dimensioned and positioned parallel to the cylinder so that one stretch of the belt loop, denominated the operative stretch, extends the entire length of the cylinder and may be brought into contact with the surface of the cylinder or, more particularly, with a lithographic plate mounted to that surface. Secured to the outer surface of the belt loop all along its length are alternating relatively stiff scrubbing pads and relatively soft brush pads to be described in more detail later.

The apparatus also has motive means for advancing the belt loop and a special pneumatic mechanism to be described for controllably pressing the cleaning pads on the operative belt loop stretch against the surface of the plate on the plate cylinder when it is desired to clean that plate. When the pads are in motion and pressed against the plate, the scrubbing pads scrub the surface of the plate and are quite effective in removing from the plate the surface layer and any residual metallic layer material at those areas of the plate that have been imaged by the write head. On the other hand, the brush pads on the belt loop are equally effective in sweeping away any debris remaining on the surface of the plate.

Provision is also made for cleaning the pads on the belt loop. More particularly, a vacuum cleaning mechanism is intimately associated with the pad-carrying belt which is quite effective in removing dirt and debris from the pads so that the apparatus can operate for a relatively long time without requiring maintenance.

BRIEF DESCRIPTION OF THE DRAWINGS

For a fuller understanding of the nature and objects of the invention, reference should be had to the following detailed description taken in connection with the accompanying drawings, in which.

DESCRIPTION OF THE PREFERRED EMBODIMENT

Figure 1:
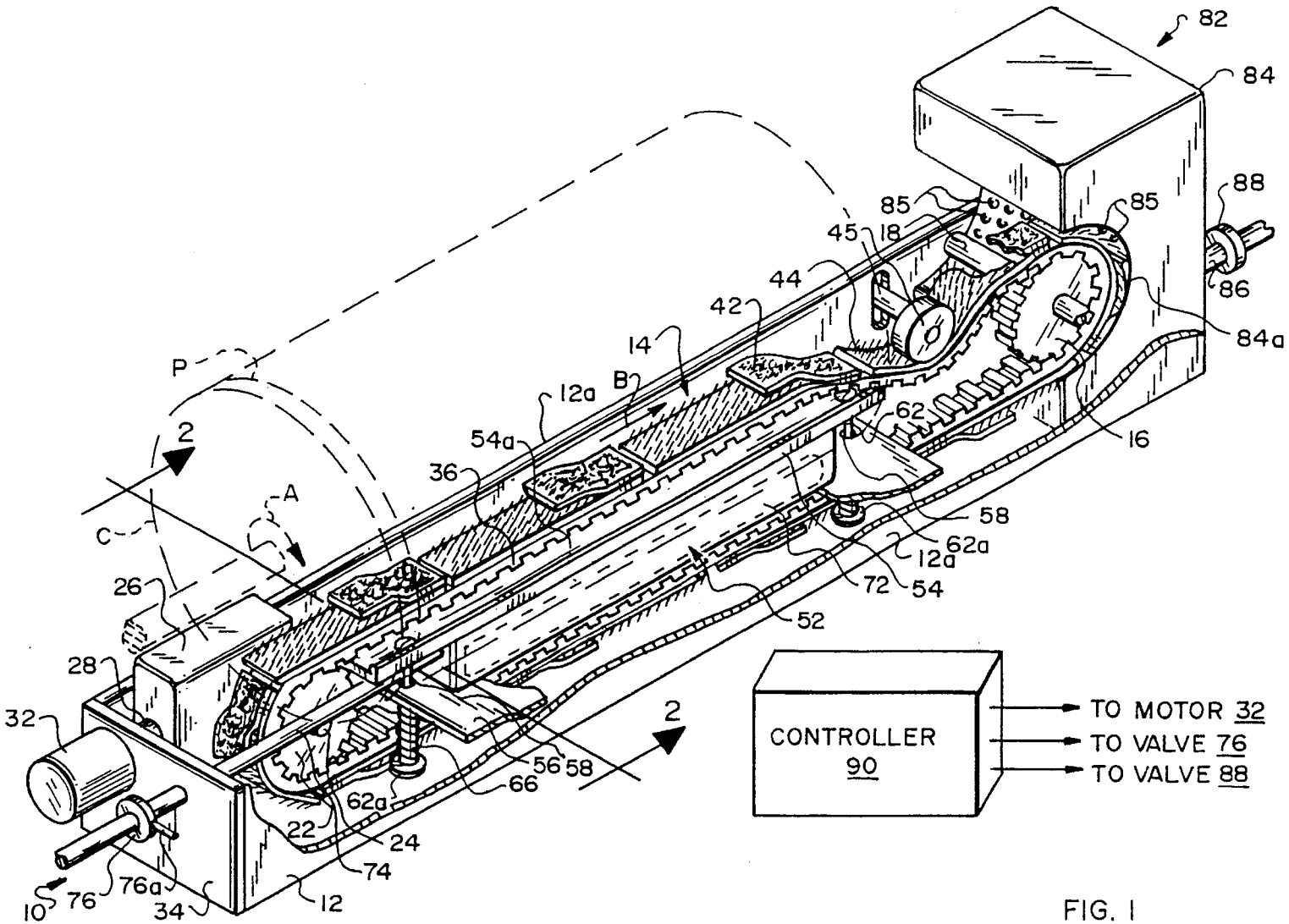
FIG. 1 is a diagrammatic perspective view with parts broken away showing plate cleaning apparatus embodying the invention.

Referring to FIG. 1 of the drawings, our plate cleaning apparatus, shown generally at 10, is juxtaposed to a plate cylinder C shown in phantom, there being a lithographic plate P wrapped around that cylinder. The cylinder C may be a plate cylinder in an offset press or it may be a cylinder in platemaking apparatus or other stand alone apparatus associated with platemaking.

The cleaning apparatus 10 is shown disposed under cylinder C. If the cylinder C constitutes a plate cylinder of an offset press, there may be a write head positioned above the cylinder so that if the cylinder is rotated clockwise in the direction of the arrow A, the cleaning apparatus would be in a position to clean the surface of plate P during or following imaging of the plate by the write head.

The cleaning apparatus 10 comprises an elongated channel-like housing 12 having opposite sidewalls 12*a*. Positioned in housing 12 is a belt assembly shown generally at 14. Assembly 14 comprises a first pulley 16, which may toothed or smooth, rotatably mounted to an axle 18 extending between the housing sidewalls 12*a* at one end of the housing. Assembly 14 also includes a toothed pulley 22, at the opposite end of the housing which is connected to the output shaft 24 of a speed-reducing gear box 26 positioned in housing 12. The gear box 26 has an input shaft 28 driven by an electric motor 32 mounted to an end plate 34 secured to the adjacent end of housing 12.

Stretched between the pulleys 16 and 22 is an endless belt loop 36 whose interior surface is toothed to match the teeth on the pulley(s). The upper operative stretch of the loop is positioned so that it is parallel to the cylinder C and located very close to the cylinder surface.

Mounted to the outer surface of the belt loop 36 is a multiplicity of cleaning pads in the form of abrasive or scrubbing pads 42 and brush pads 44 both of which pads will be described in more detail later. Suffice it to say at this point that the pads are positioned on the outer surface of the belt loop so that they alternate all around the belt loop.

When the motor 32 is energized, the gear box 26 drives pulley 22 so as to advance the belt loop 36 in the direction of the arrow B in FIG. 1, i.e., so that the upper or operative belt stretch moves toward the right. Preferably, the belt assembly 14 includes a floating tensioning pulley 45 which is biased downward against the upper stretch of the belt loop to maintain the loop in a tensioned condition.

Figure 2:
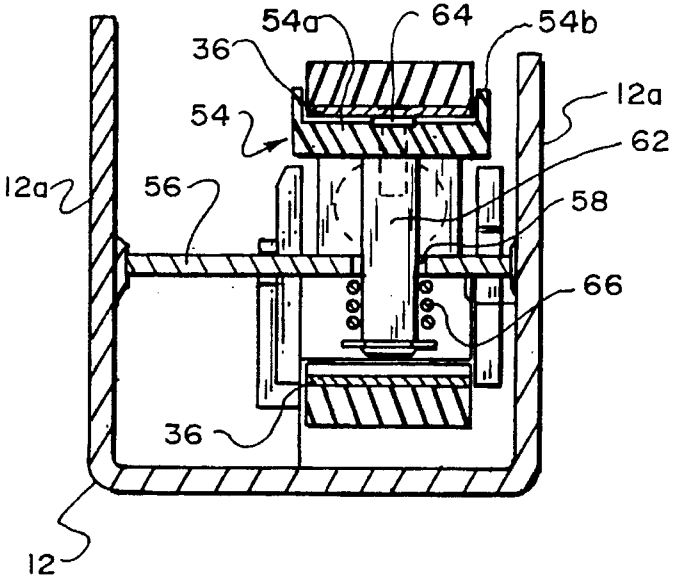
FIG. 2 is a sectional view on a larger scale taken along line 2—2 of FIG. 1.

Further in accordance with this invention and as seen in FIGS. 1 and 2, a pneumatic actuator shown generally at 52 is positioned inside the belt loop 36. The actuator 52 comprises an elongated, relatively stiff pad 54 which is located just under the upper stretch of the belt loop 36. Pad 54 should be at least as long as the cylinder C and preferably its upper surface 54*a* is smooth and wear resistant. Preferably also, as shown in FIG. 2, the pad 54 has upwardly extending sidewalls or lips 54*b* to guide belt 36 as its slides over pad surface 54*a*.

Spaced below pad 54 is a support plate 56 suspended between the housing sidewalls 12*a*. A pair of holes 58 are provided adjacent to opposite ends of plate 56 for receiving a pair of headed posts 62, the shank ends of which extend up to pad 54 and are secured thereto by screws 64 extending through pad 54 and threaded into the upper ends of posts 62. Compressed between the heads 62*a* of posts 62 and the support plate 56 are coil springs 66 which tend to draw the pad 54 downward away from the upper stretch of the belt loop 36.

Pad 54 is urged upwardly in opposition to the bias of springs 66 by a bladder 72 located on the support plate 56 under pad 54. Bladder 72 may be filled with air or other fluid by way of a pipe 74 which extends from the left hand end of the bladder through the end plate 34 where it is connected by way of a solenoid-actuated two-way valve 76 to a source of pressurized air or other fluid. When valve 76 is in one position, bladder 72 is filled with air. Resultantly, the bladder urges pad 54 against the underside of the upper stretch of the belt loop 36 thereby pressing the cleaning pads 42, 44 against the plate P on cylinder C. On the other hand, when valve 76 is in its other position, the air from bladder 72 is vented to the atmosphere via valve port 76*a*, thereby allowing the pad 54 to be pulled downward away from the belt by springs 66.

Thus, when the bladder 72 is inflated, the actuator presses the pads 42, 44 uniformly against the plate P. On the other hand, when that air pressure is removed from the bladder, the actuator immediately retracts the belt and the pads thereon to an out of the way position away from the plate.

Referring to FIG. 1, the cleaning apparatus 10 also includes provision for cleaning the pads 42, 44, on the belt loop 36. More particularly, a vacuum cleaning mechanism shown generally at 82 is positioned adjacent to the belt pulley 16. The vacuum cleaning mechanism comprises a housing or manifold 84 which has a curved face 84*a* which wraps around the belt pulley 16 and the belt segment thereon. The manifold face 84*a* is provided with a multiplicity of small holes 85 which are located directly opposite and close to the pads 42, 44 on the belt loop 36.

One end of a pipe 86 is connected to the interior of manifold 84. The opposite end of that pipe is connected by way of a solenoid actuated valve 88 to a source of high vacuum or to a vacuum pump (not shown). When valve 88 is in its open position, a multiplicity of very localized vacuum sources exist right opposite the surfaces of the pads 42, 44 at the housing surface 84*a*. This vacuum is strong enough to scrub the surfaces of the pads 42 and to remove dirt and debris from between the bristles of the brush pads 44.

The belt drive motor 32 and the valves 76 and 88 (or vacuum pump) may be controlled by a suitable controller 90 which may be a separate controller if the cleaning apparatus 10 is a stand alone device. Alternatively, the controller may be incorporated into the control section of a press or platemaking apparatus.

Suffice it to say that controller 90 is programmed so as to turn on motor 32 and open valve 88 (or turn on the vacuum) pump when it is desired to clean the plate P on the cylinder C either during or after imaging of the plate. At that time, the controller will also actuate valve 76 so as to inflate bladder 72. The inflation of the bladder will exert uniform pressure on pad 54 causing the upper stretch of the belt 36 and the pads 42, 44 thereon to be pressed firmly and uniformly against the surface of plate P. Resultantly, as the cylinder C rotates in the direction of the arrow A, the surface of plate P will be alternately scrubbed by the stiff pads 42 and then brushed by the brush pads 44. This dual-action cleaning process can effectively remove substantially all ablated material and debris from the entire surface of the plate P in as few as one or two revolutions of cylinder C.

Figure 3:
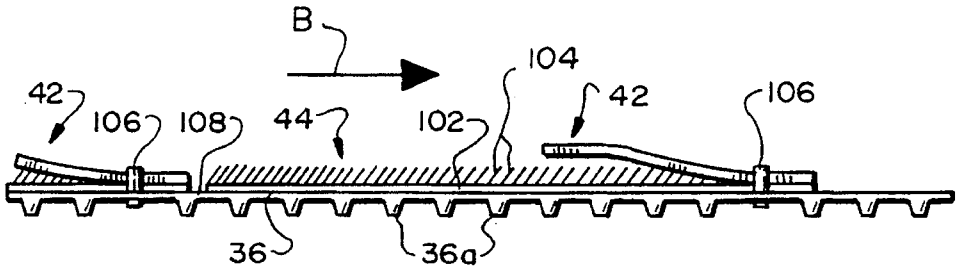
FIG. 3 is a fragmentary view in side elevation showing a portion of the FIG. 1 apparatus in greater detail.

Refer now to FIG. 3 which illustrates the cleaning pads 42, 44 on belt loop 36 in greater detail.

A typical cleaning apparatus 10 may have twenty each of the cleaning pads 42, 44 mounted to the belt loop 36. In that event, each brush pad 44 may be in the order of 2.3 inches long and 0.75 inches wide. Each brush pad 44 includes a rectangular backing layer 102 for supporting a pile of upstanding bristles 104. As shown in FIG. 3, the bristles 104 have a natural lay in the direction of movement of the belt, i.e., the direction of the arrow B in FIGS. 1 and 3.

The abrasive or scrubbing pads 42 are also rectangular being in the order of 0.75 inch long and 0.75 inch wide. Preferably, pads 42 are made of a relatively stiff, yet flexible polyurethane material and have a natural side-to-side camber or curl. Preferably also, the upper or exposed surfaces of pads 42 are textured. The abrasive pads 42 and the brush pads 44 are mounted to the belt so that the pads 42 overlap the pads 44 and so that the leading or right hand edges of the pads 42, 44 are in registration as shown in FIG. 3. Since the right end segments of the pads are superimposed thusly, the right end segments of backing layers 102 should be devoid of bristles 104. The pads 42 and 44 may be secured to belt 36 by staples 106 or other suitable means. To provide clearance for the staples, the teeth or cogs 36*a* of belt 36 may be removed at the locations of the staples as shown in FIG. 3.

Typically, the abrasive pad 42 overlaps the bristled segment of the brush pad 44 by about 0.35 inch and there is a small gap 108 between adjacent pairs of pads 42, 44 of about 0.1 inch.

It will be seen from the foregoing, then, that our cleaning apparatus 10 is quite versatile and able to clean lithographic plates on press either during or after imaging of the plate. It can also be incorporated into platemaking apparatus for imaging plates off press or into stand alone equipment associated with a platemaker. The apparatus 10 is quite small and compact and can be slid into place in the associated apparatus with provision being made for quick coupling of the electrical and pneumatic connections of the apparatus to suitable connectors or fittings in the press or platemaker.

Cleaning apparatus 10 is also quite efficient in that it spans the plate being cleaned and can thus clean the entire surface of the plate during a few revolutions of the cylinder on which the plate is mounted. Thus, the entire cleaning operation can be carried out in a minimum amount of time. Further, since the apparatus intimately vacuum cleans the cleaning pads 42, 44, the apparatus can operate for a prolonged period of time without having to remove the belt loop 36 in order to clean or replace the cleaning pads 42, 44.

It will thus be seen that the objects set forth above, among those made apparent from the preceding description, are efficiently attained and, since certain changes may be made in the above construction without departing from the scope of the invention, it is intended that all matter contained in the above description or shown in the accompanying drawings shall be interpreted as illustrative and not in a limiting sense.

It is also to be understood that the following claims are intended to cover all of the generic and specific features of the invention described herein.

We claim:

1. Cleaning apparatus for cleaning a lithographic plate mounted to a rotary plate cylinder having an axis of rotation, said apparatus comprising fixed support means;

an endless belt supported by the support means so that a segment thereof extends in front of the support means close to said cylinder and substantially parallel to said axis;

plate cleaning means mounted to the belt all along the belt;

means for advancing the belt segment parallel to the cylinder axis;

an inflatable bladder positioned between said belt segment and said support means, and means for selectively filling the bladder with fluid so that the bladder inflates and exerts substantially uniform pressure against substantially the entire length of the belt segment so as to urge the cleaning means thereon with uniform force against a plate mounted to the plate cylinder while the cylinder rotates.

2. The apparatus defined in claim 1 and further including vacuum cleaning means positioned adjacent to the belt so that as the belt advances, the cleaning means are moved past the vacuum cleaning means and are cleaned thereby.

3. The apparatus defined in claim 1 wherein said bladder has a flat wall facing said belt segment.

4. Cleaning apparatus for cleaning a lithographic plate mounted to a rotary plate cylinder, said apparatus comprising an endless belt having a segment extending close to and substantially parallel to said cylinder;

plate cleaning means mounted to the belt all along the belt;

means for advancing the belt along the cylinder, and pressing means for selectively pressing the belt segment and plate cleaning means thereon against a plate mounted to the plate cylinder while the cylinder rotates wherein said plate cleaning means comprise scrubbing pads and brush pads secured to a surface of the belt.

5. The apparatus defined in claim 4 wherein said scrubbing pads and said brush pads alternate all along the belt.

6. The apparatus defined in claim 5 wherein said scrubbing pads overlap said brush pads.

7. The apparatus defined in claim 4 wherein said brush pads have bristles with a natural lay in the direction of advancement of said belt.

8. The apparatus defined in claim 4 wherein said scrubbing pads are of a polyurethane material.

9. Cleaning apparatus for cleaning a lithographic plate mounted to a rotary plate cylinder, said apparatus comprising support means;

a pair of aligned rotary pulleys supported by the support means at spaced apart locations thereon;

an endless belt loop stretched between said pulleys, said loop having an outer surface and an operative stretch between said pulleys located in front of said support means parallel to and opposite said cylinder;

a multiplicity of plate cleaning means anchored to the outer surface of the belt loop;

drive means for rotating at least one of the pulleys;

an inflatable bladder positioned between the operative stretch of the belt loop and the support means and which extends substantially the entire length of said belt loop stretch;

means for venting gas from the bladder, and control means for controlling the filling and venting of said bladder so that when the bladder is filled with gas it inflates and exerts substantially uniform pressure against substantially the entire length of said operative stretch of the belt loop so as to urge said multiplicity of cleaning means thereon with uniform force against a plate mounted to the plate cylinder while the cylinder rotates and when said bladder is vented, said operative stretch of the belt loop is spaced from the plate cylinder.

10. The apparatus defined in claim 9 wherein said cleaning means comprise scrubbing pads and brush pads.

11. The apparatus defined in claim 10 wherein the scrubbing pads and brush pads alternate all along the belt loop.

12. The apparatus defined in claim 9 and further including means for drawing said bladder away from said operative stretch of the belt loop when the bladder is vented.

13. The apparatus defined in claim 9 and further including means mounted to said support adjacent to said belt loop for cleaning said cleaning means.

14. The apparatus defined in claim 13 wherein the means for cleaning the plate cleaning means include a vacuum cleaning means.

15. The apparatus defined in claim 13 wherein the vacuum cleaning means comprise a manifold having a wall directly opposite the plate cleaning means on the belt loop a multiplicity of small holes in said wall, and means for producing a vacuum in said manifold.

* * * * *